United States Patent [19]

Maxim

[11] Patent Number: 4,476,648

[45] Date of Patent: Oct. 16, 1984

[54] FLOAT ACTIVATED TOY VEHICLE

[76] Inventor: John Maxim, 25 Mill Valley La., North Stamford, Conn. 06903

[21] Appl. No.: 463,749

[22] Filed: Feb. 4, 1983

[51] Int. Cl.[3] ..... A63H 17/00

[52] U.S. Cl. ..... 446/166; 446/267; 446/462; 200/61.1; 200/84 R; 446/484

[58] Field of Search ..... 46/41, 45, 94, 248, 46/249, 250, 251, 264, 265, 266; 200/61.1, 61.2, 84 R

[56] References Cited

U.S. PATENT DOCUMENTS

| | | | |
|---|---|---|---|
| 2,832,177 | 4/1958 | Mueller | 46/45 X |
| 2,885,507 | 5/1959 | Holman | 200/84 R |
| 3,504,145 | 3/1970 | Layher | 200/84 R |
| 4,347,683 | 9/1982 | Maxim | 46/45 X |

*Primary Examiner*—F. Barry Shay

*Attorney, Agent, or Firm*—Blum, Kaplan, Friedman, Silberman & Beran

[57] ABSTRACT

A motorized toy vehicle actuated by liquid such as water is provided. The toy vehicle includes a frame having wheels rotatably supported thereon and a motor operatively coupled to the wheels for rotating the wheels. A reservoir having a float disposed therein is supported on the toy vehicle frame. A switch selectively actuated by the float is coupled to the motor. When a predetermined amount of liquid is present in the reservoir, the float will actuate the switch thereby turning on the motor.

25 Claims, 5 Drawing Figures

FLOAT ACTIVATED TOY VEHICLE

BACKGROUND OF INVENTION

The present invention is directed to a motorized toy vehicle and, in particular, to a toy vehicle in which a switch coupled to the toy vehicle motor is selectively actuated by a float in a reservoir on the toy vehicle body according to the amount of liquid present in the reservoir.

Several different embodiments of toys, such as toy vehicles and dolls, which are actuated in response to the presence of a conductive fluid in a reservoir on the body or frame of the toy are disclosed in my U.S. Pat. No. 4,347,683 entitled Conductive Fluid Activated Devices. In one embodiment of a toy vehicle disclosed in U.S. Pat. No. 4,347,683, a pair of probes, coupled to electronic circuitry, are spaced in a reservoir on the toy vehicle chassis. The configuration of the probes and reservoir and the presence and motion of a conductive fluid such as water in the reservoir determines the manner in which the probes will be electrically coupled to actuate the electronic circuitry. A motor adapted to drive the wheels of the vehicle is actuated in response to actuation of the electronic circuitry.

Toy vehicles constructed in accordance with my U.S. Pat. No. 4,347,683 provide a toy having an enhanced play value since the toy vehicle simulates an actual gas-powered vehicle where the presence or absence of a conductive fluid such as water determines the performance and operation of the toy vehicle. Such toy vehicles have met with great commercial success. A reduction in the size and cost of such toy vehicles, for example by eliminating the electronic circuitry, while retaining the play value associated with such toys would be desirable. Accordingly, it would be desirable if another type of fluid activated toy vehicle could be provided wherein the presence of a fluid such as water in the toy vehicle determines whether the toy vehicle motor will be actuated thereby simulating an actual gas-powered vehicle.

SUMMARY OF THE INVENTION

Generally speaking, in accordance with the present invention, a motorized toy vehicle is provided which "runs" on water. The toy vehicle includes a toy vehicle frame and wheels rotatably supported on the frame. A motor is operatively coupled to the wheels for rotating the wheels. A reservoir capable of receiving a liquid such as water is carried on the frame. A switch coupled to the motor for turning the motor on and off is supported on the frame and a float device which selectively actuates the switch is supported in the reservoir. The float is buoyantly displaceable by the presence of liquid in the reservoir between a first position where the switch is actuated by the float when at least a predetermined amount of liquid is present in the reservoir and a second position where the switch remains unactuated when the at least predetermined amount of liquid is absent from the reservoir.

In a preferred embodiment, the switch is a contact switch having normally spaced contact leafs which project over an opening in the reservoir. A diaphragm covers the opening in the reservoir. When a predetermined amount of liquid is present in the reservoir, a projection on the float device presses against the diaphragm which causes the diaphragm to bulge against one of the leafs of the switch to press it against the other leaf to close the switch thereby actuating the motor. The reservoir may include a second opening through which controlled liquid metering may occur. A secondary reservoir or drain tank may be provided for receiving the metered liquid. As the liquid level in the main reservoir decreases through metering out of the second opening, the level of the float will change thereby decreasing the pressure on the diaphragm which in turn causes the switch contact leafs to separate thereby stopping operation of the motor.

A toy vehicle in accordance with the present invention has a high play value level since the toy vehicle simulates an actual gas-powered vehicle which will run until the vehicle "runs out of gas". The vehicle is inexpensive to manufacture and can be made relatively small.

Accordingly, it is an object of the instant invention to provide an improved toy vehicle actuated by a liquid.

Another object of the present invention is to provide a float activated toy vehicle.

A further object of the present invention is to provide a float activated toy vehicle in which the presence of a liquid determines whether the vehicle motor will operate.

A still further object of the instant invention is to provide a toy vehicle which simulates an actual gas-powered vehicle which has a high play value level.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
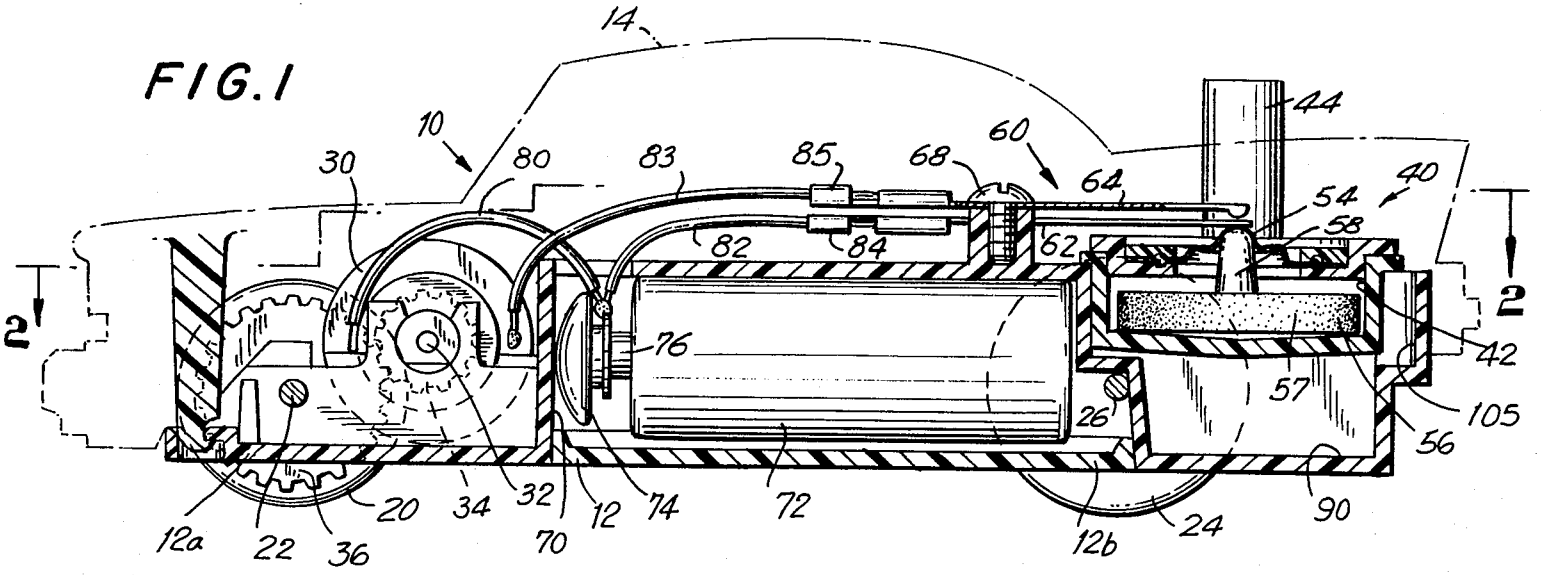
FIG. 1 is a cross-sectional view of a float activated toy vehicle constructed in accordance with a preferred embodiment of the present invention with the toy vehicle body shown in phantom.
Figure 5:
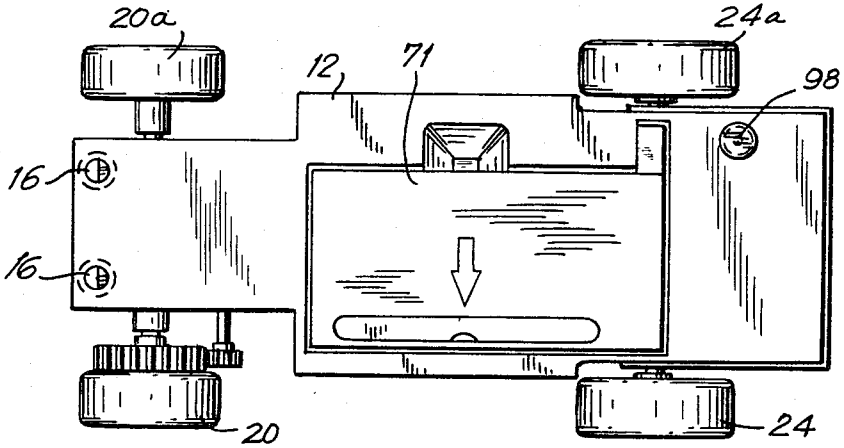
FIG. 5 is a bottom plan view of the toy vehicle constructed in accordance with the present invention.

Reference is made to the drawings wherein a toy vehicle, generally indicated at 10, constructed in accordance with a preferred embodiment of the present invention, is depicted. Toy car 10 includes a chassis 12 having a body 14 depicted in phantom in FIG. 1 disposed thereon. Body 14 is secured to chassis 12 by means of screws 16. Chassis 12 and body 14 are preferably formed of a resilient plastic material. A pair of front wheels 20 and **20*a* are rotatably coupled to front end 12*a* of chassis 12 by means of an axle 22. Similarly, a pair of rear wheels 24 and 24***a* are rotatably coupled to rear end 12*b* of chassis 12 by means of an axle 26.

A conventional DC motor 30 is supported on front end 12*a* of chassis 12. Motor 30 includes a drive shaft 32 having a gear 34 affixed thereto and rotatable therewith. Gear 34 may be a pinion gear. A gear 36 is fixed to front axle 22 adjacent front wheel 20. Gear 36 meshes with gear 34 of motor 30 so that when drive shaft 32 of motor 30 is rotating, gear 34 will cause rotation of front axle 22 thereby resulting in rotation of front wheels 20 and 20*a* to propel toy vehicle 10.

A float and reservoir assembly, generally indicated at 40, is supported on rear end 12*b* of chassis 12. Assembly 40 includes a reservoir 42 having a filling neck 44 with an opening 46 which communicates with reservoir 42. Reservoir 42 also includes an air release port 48 which includes an opening 50 which communicates with reservoir 42.

Reservoir 42 includes an opening 52 having a flexible sheet or diaphragm 54 disposed across opening 52. Diaphragm 54 may be a latex or rubber membrane or other deformable material. A plastic float 56 having a buoyant material 57 such as styrofoam or the like coupled thereto is disposed in reservoir 42. Float 56 includes a rigid projection 58 which extends towards opening 52 against diaphragm 54.

A switch mechanism generally indicated at 60, includes first and second resilient contact leafs 62 and 64 which are respectively coupled to chassis 12 by means of screws 66 and 68. End 62*a* of contact leaf 62 is disposed so as to extend over and substantially rest on diaphragm 54. End 64*a* of contact leaf 64 extends over and is normally spaced from end 62*a* of contact 62.

A battery compartment 70 is adapted to receive and support a battery 72 such as a 9 V battery. A removable battery cover 71 is provided to secure battery 72 in battery compartment 70. A battery cap 74 is provided for coupling to terminals 76 of battery 72. A first lead 80 is coupled intermediate motor 30 and a first terminal 76 of battery 72. A second lead 82 is coupled intermediate the second terminal 76 of battery 72 and first contact leaf 62. A third lead 83 is coupled intermediate motor 30 and second contact leaf 64. To facilitate coupling of leads 82 and 83 to contact leafs 62 and 64 respectively, friction couplings 84 and 85 may be provided.

A drain tank or secondary reservoir 90 is disposed below reservoir 42. An opening 92 is provided in reservoir 42 which communicates with drain tank 90. A metering pad 94 for impeding the flow is made of felt, sponge material or the like and is disposed in opening 92. Reservoir 92 includes an opening 96 in which a plug 98 is removably secured. Plug 98 is coupled to metering pad 94 by means of a rod 100.

Figure 4:
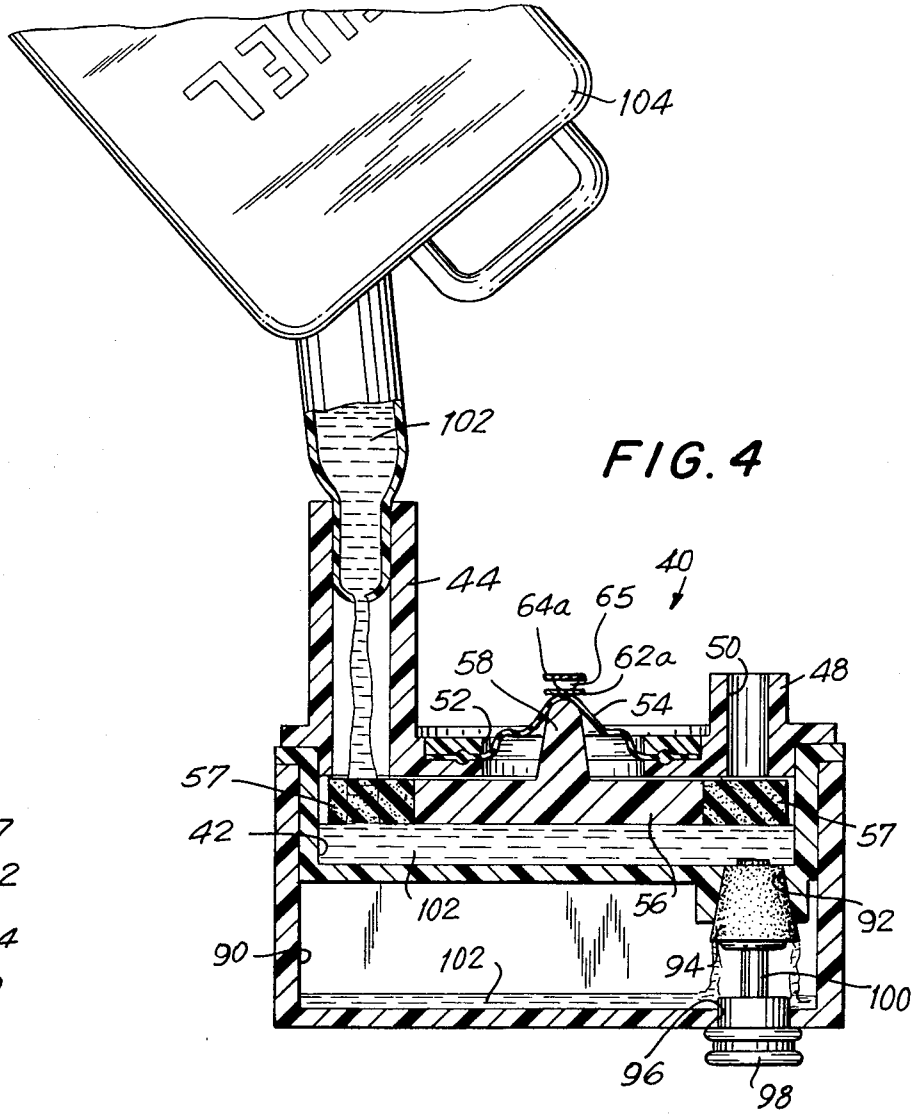
FIG. 4 is a cross-sectional view similar to FIG. 3 but showing the manner of introduction and presence of liquid in the toy vehicle reservoir.
Figure 3:
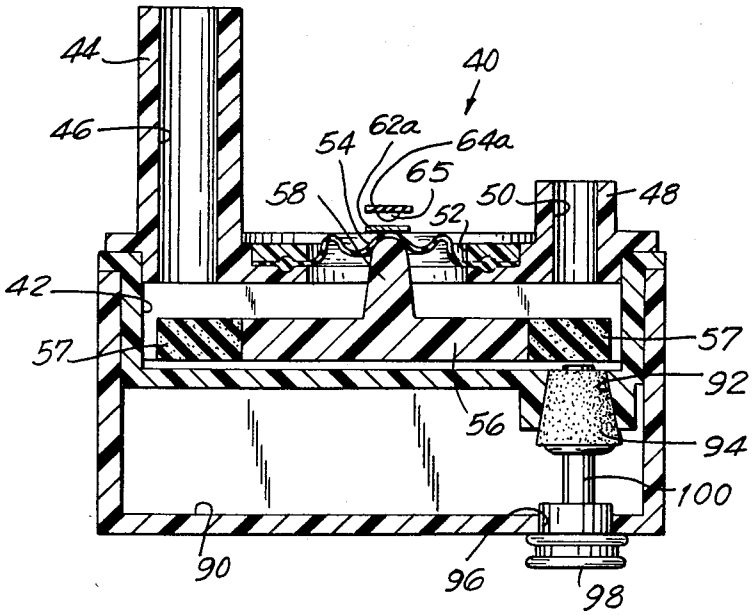
FIG. 3 is an enlarged sectional view taken along line 3—3 of FIG. 2.

The operation of toy vehicle 10 will now be described. Since contact leafs 62 and 64 and specifically terminals 62*a* and 64*a* thereof are normally disposed in spaced relation as best depicted in FIGS. 1 and 3, an open circuit is present and no power is supplied to motor 30. When a liquid 102 is introduced through filler neck 44 into reservoir 42, the buoyant property of material 57 of float 56 will cause it to rise, as best depicted in FIG. 4. A simulated plastic fuel tank 104 which is filled with water may be utilized to introduce liquid 102 through opening 46 of filler neck 44 into reservoir 42. When a sufficient amount of water 102 is introduced into reservoir 42, projection 58 will cause sufficient deformation of diaphragm 54 to press terminal 62*a* of contact leaf 62 against terminal 64*a* of contact leaf 64. In order to insure proper electrical coupling, terminal 64*a* may include a conductive projection 65 which faces terminal 62*a*.

When terminal 62*a* of contact leaf 62 is pressed against terminal 64*a* of contact leaf 64 as depicted in FIG. 4, a closed circuit is defined between battery 72 and motor 30 and power is supplied to motor 30 thereby causing drive shaft 32 thereof to rotate. The rotation of drive shaft 32 will be transferred to front wheels 20 and 20*a* through gears 34 and 36 and front axle 22 thereby propelling the car in a forward direction. THe proper polarity of battery 72 is selected so that motor 30 drives car 10 in a forward direction.

Diaphragm 54 serves two purposes. First, it normally biases projection 58 and hence float 56 away from terminal 62*a* of contact leaf 62 to provide normal spacing between contact leafs 62 and 64. Second, diaphragm 54 prevents liquid in reservoir 42 from wetting contact leafs 62 and 64 which could result in damage thereto or inadvertant closing of the circuit. Exhaust tube 48 permits the escape of air as liquid 102 is introduced through filling spout 44 into reservoir 42.

Figure 2:
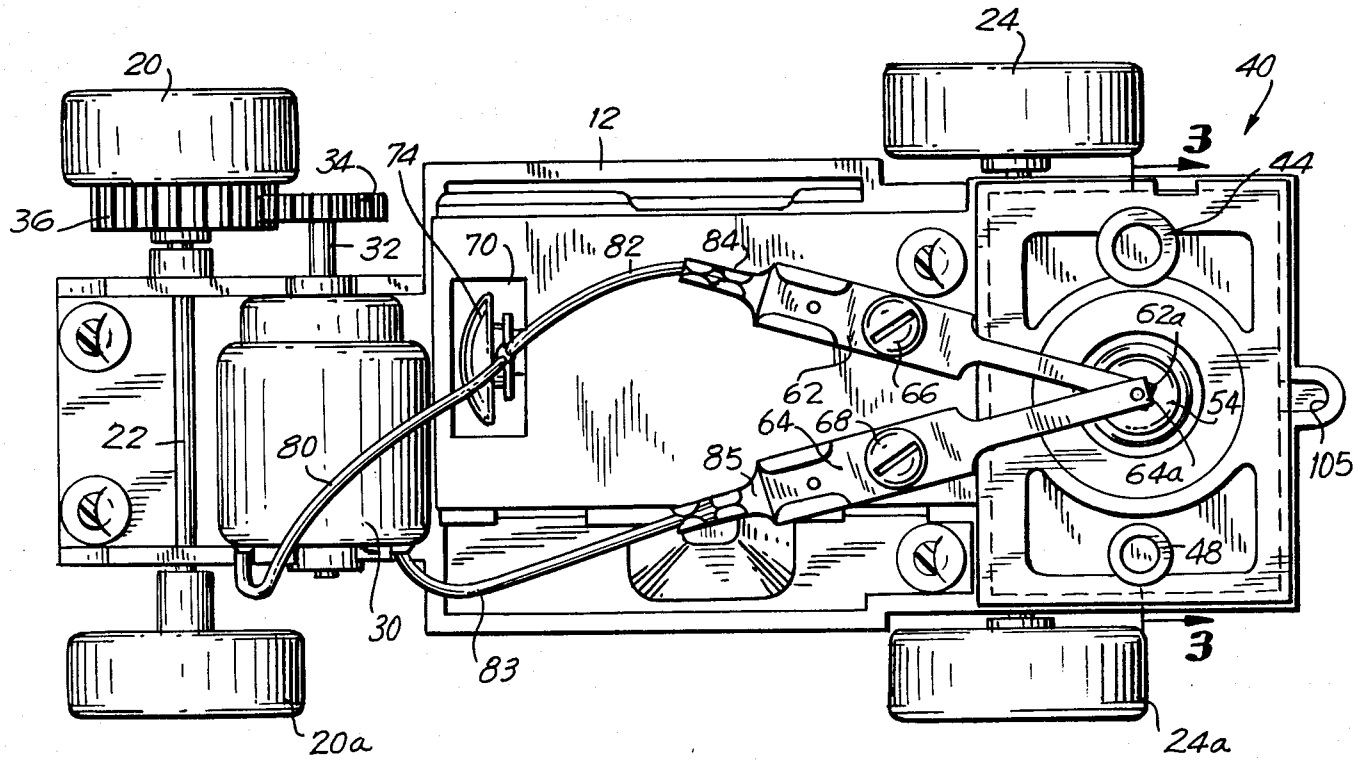
FIG. 2 is a sectional view taken along line 2—2 of FIG. 1.

Metering pad 94 permits slow draining or filtering of liquid 102 from reservoir 42 into drain tank 90. As the liquid slowly drains through opening 92 into drain tank 90, the level of liquid in reservoir 42 will be decreased. Eventually, projection 58 of float 56 will drop to a sufficient level so that terminal 62*a* moves out of contact with terminal 64*a* thereby opening the circuit and causing the car to stop running. This provides a simulation of an actual gas-powered vehicle which eventually runs out of gas. After several fillings of reservoir 42 and the subsequent draining into drain tank 90, plug 98 may be removed to drain out water 102. An opening 105, best depicted in FIGS. 1 and 2 opens drain tank 90 to atmosphere so that as liquid 102 slowly drains into drain tank 90, air can escape through opening 105.

An override on-off switch for the toy vehicle may be provided to prevent drainage of the battery when the toy vehicle is not being used.

The float activated toy vehicle of the present invention provides a toy vehicle which simulates an actual gas-powered vehicle which substantially enhances the play value of the toy vehicle. The vehicle runs on a conventional 9 V battery although it is recognized that other types and sizes of batteries may be utilized. The toy vehicle is easy and inexpensive to manufacture and is safe for use by children since the preferred liquid of water is utilized.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A device comprising a toy vehicle frame, driven means at least simulating means for propelling said frame coupled to said toy vehicle frame, motor means supported on said frame operatively coupled to said driven means for driving same, reservoir means carried on said frame having an opening, said reservoir means being capable of receiving and accumulating a liquid, switch means supported on said frame and coupled to said motor means for actuating said motor means, and float means supported in said reservoir means, said float means being buoyantly displaceable by said liquid between a first position where said switch means is actuated by said float means when at least a predetermined amount of said liquid is present in said reservoir means and a second position where said switch means remains unactuated when less than said at least predetermined amount of liquid is present in said reservoir means.

2. The device as claimed in claim 1, wherein said reservoir means includes a first opening and diaphragm means covering said first opening for biasing said float means away from said swtich means, said float means deforming said diaphragm means to actuate said switch means when said float means is disposed in its first position.

3. The device as claimed in claim 2, further comprising metering means associated with said reservoir means for permitting said liquid in said reservoir means to drain out of said reservoir means.

4. The device as claimed in claim 3, further comprising a drain tank carried on said frame, said liquid flowing into said drain tank as it drains out of said reservoir means.

5. The device as claimed in claim 4, wherein said metering means includes a second opening in said reservoir means placing said reservoir means in fluid communication with said drain tank.

6. The device as claimed in claim 5, wherein said metering means includes a metering pad disposed in said second opening to control the rate of metering of said liquid.

7. The device as claimed in claim 6, wherein said metering pad is a sponge.

8. The device as claimed in claim 6, wherein said metering pad is made from a felt material.

9. The device as claimed in claim 2, wherein said reservoir means includes a third opening through which said liquid can be introduced to said reservoir means and a fourth opening communicating said reservoir means to the ambient atmosphere.

10. The device as claimed in claim 4, wherein said drain tank inludes a fifth opening communicating said drain tank to the ambient atmosphere.

11. The device as claimed in claim 10, wherein said drain tank includes a sixth opening for draining liquid out of said drain tank and plug means for releaseably closing off said sixth opening.

12. The device as claimed in claim 2, wherein said motor means includes gear means for coupling said motor means to said driven means.

13. The device as claimed in claim 12, wherein said driven means includes at least one wheel rotatably disposed on said frame.

14. The device as claimed in claim 5, wherein said switch means includes a first terminal disposed in registration with said diaphragm means and a second terminal disposed proximate said first terminal, said float means deforming said diaphragm means against said first terminal to press said first terminal against said second terminal when said float means is in said first position.

15. The device as claimed in claim 14, wherein said first and second terminals are resilient, said resilient first and second terminals being displaceable by said diaphragm means when said float means is in said first position.

16. The device as claimed in claim 14, wherein said motor means is operated when said first terminal contacts said second terminal.

17. The device as claimed in claim 2, wherein said float means includes a rigid projection facing said diaphragm means, said rigid projection pressing against said diaphragm means to deform said diaphragm means when said float means is in said first position.

18. The device as claimed in claim 17, wherein said float means inludes a buoyant material.

19. The device as claimed in claim 18, wherein said buoyant material is styrofoam.

20. The device as claimed in claim 2, wherein said switch means remains actuated when greater than said predetermined amount of liquid up to the capacity of said reservoir means is present in said reservoir means.

21. A toy vehicle comprising a chassis, front and rear wheels rotatably coupled to said chassis, motor means supported on said chassis for rotating at least one of said front and rear wheels, switch means coupled to said motor means for selectively actuating said motor means, reservoir means supported on said chassis for receiving and accumulating a liquid, float means disposed in said reservoir means for actuating said switch means, said float means being buoyantly supported by said liquid when the liquid is present in said reservoir means, said switch means being actuated by said float means when at least a predetermined amount of the liquid is present in said reservoir means, said switch means being unactuated by said float means when less than said at least predetermined amount of liquid is present in said reservoir means.

22. The toy vehicle as claimed in claim 21, wherein said reservoir means includes metering means for permitting said liquid to drain out of said reservoir means.

23. The toy vehicle as claimed in claim 22, further comprising a drain tank means supported on said chassis for receiving and storing the liquid drained out of said reservoir means by said metering means.

24. The toy vehicle as claimed in claim 23, wherein said reservoir means includes a first opening and diaphragm means for covering said opening, said switch means being disposed proximate said diaphragm means, said float means pressing said diaphragm means against said switch means to actuate said swtich means when said at least predetermined amount of liquid is present in said reservoir means.

25. The toy vehicle as claimed in claim 24, wherein said switch means remains actuated when greater than said predetermined amount of liquid is present in said reservoir means.

* * * * *